US006295830B1

(12) United States Patent
Newman

(10) Patent No.: US 6,295,830 B1
(45) Date of Patent: Oct. 2, 2001

(54) PORTABLE CONTAINER FOR REFRIGERATED OR FROZEN GOODS

(75) Inventor: Michael D. Newman, Hillsborough, NJ (US)

(73) Assignee: The BOC Group, Inc., Murray Hill, NJ (US)

( * ) Notice: Subject to any disclaimer, the term of this patent is extended or adjusted under 35 U.S.C. 154(b) by 0 days.

(21) Appl. No.: 09/681,226

(22) Filed: Feb. 28, 2001

(51) Int. Cl.[7] ..... F25D 3/12; F25D 3/08
(52) U.S. Cl. ..... 62/388; 62/371
(58) Field of Search ..... 62/60, 371, 372, 62/457.7, 457.9, 388, 384

(56) References Cited

U.S. PATENT DOCUMENTS

| | | | | |
|---|---|---|---|---|
| 1,654,828 | | 1/1928 | Nelson . | |
| 1,843,038 | * | 1/1932 | McIlvain | 62/60 |
| 2,049,779 | * | 8/1936 | Routh | 62/372 |
| 2,071,303 | * | 2/1937 | Hill | 62/372 |
| 2,289,060 | * | 7/1942 | Merkle | 62/371 |
| 2,632,311 | * | 3/1953 | Sullivan | 62/371 |
| 2,989,856 | * | 6/1961 | Telkes | 62/371 |
| 3,069,869 | | 12/1962 | Mueller | 62/371 |
| 3,677,020 | | 7/1972 | Munselle | 62/10 |
| 3,678,703 | | 7/1972 | Cornish et al. | 62/371 |
| 3,800,554 | | 4/1974 | Knapp et al. | 62/384 |
| 3,971,231 | | 7/1976 | Derry | 62/388 |
| 4,294,079 | * | 10/1981 | Benson | 62/60 |
| 5,063,754 | | 11/1991 | Chou | 62/457.9 |
| 5,329,787 | | 7/1994 | Friday | 62/389 |
| 5,474,794 | | 12/1995 | Anderson et al. | 426/614 |
| 5,528,907 | | 6/1996 | Pint et al. | 62/604 |
| 5,775,127 | | 7/1998 | Zito | 62/603 |
| 5,931,019 | | 8/1999 | White et al. | 62/457.7 |
| 6,212,901 | * | 4/2001 | Pint et al. | 62/457.7 |

* cited by examiner

*Primary Examiner*—William Doerrler
(74) *Attorney, Agent, or Firm*—Joshua L. Cohen; Salvatore P. Pace

(57) ABSTRACT

A tote for transporting refrigerated or frozen goods, e.g., foodstuffs, comprises an insulated container and a coolant insert. The insulated container comprises a durable, impact-resistant shell, an insulation insert, an optional corrugated liner, and a cover. The coolant insert fits within the container such that it rests on the top edge of the insulation liner sidewalls, and it holds a coolant, e.g., carbon dioxide snow. The insert has a perforated bottom wall and an insulated top wall. When the tote holds frozen goods, the perforated bottom wall is opposite the interior of the container. When the tote holds refrigerated goods, the insulated top wall is opposite the interior of the container.

10 Claims, 3 Drawing Sheets

FIG. 5
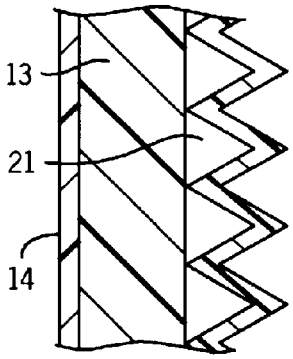
FIG. 6
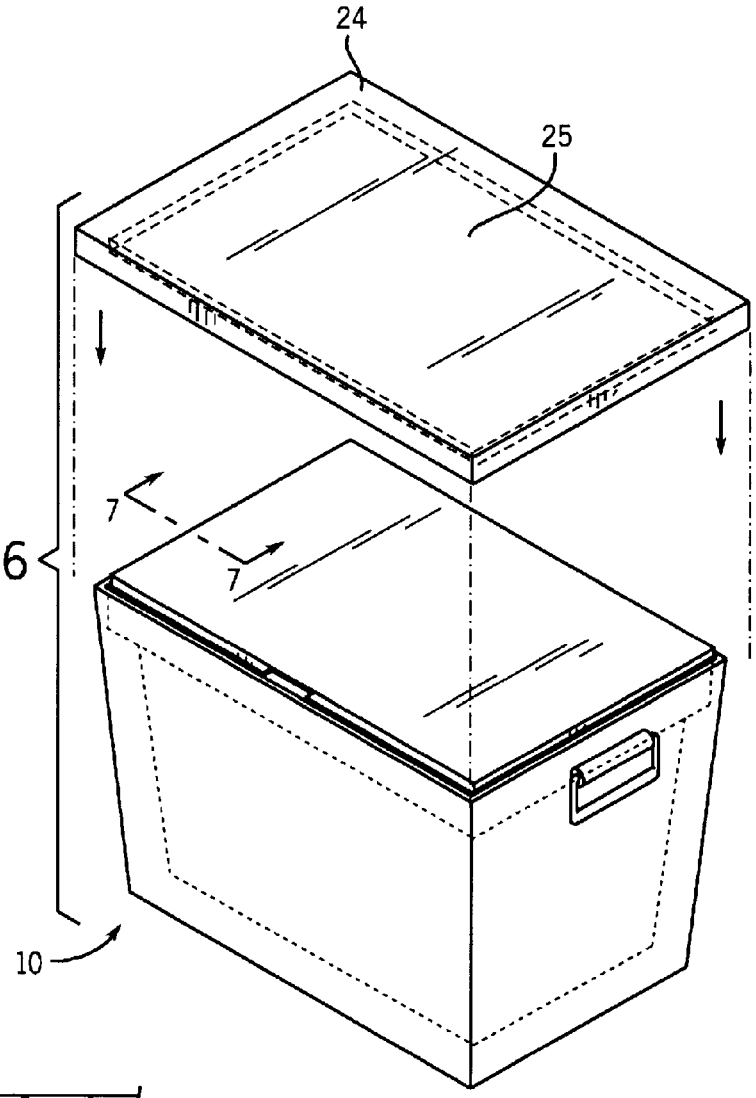
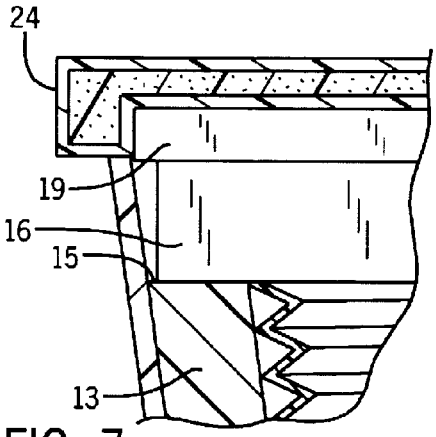
FIG. 7

PORTABLE CONTAINER FOR REFRIGERATED OR FROZEN GOODS

BACKGROUND OF INVENTION

This invention relates to a portable container. In one aspect, this invention relates to a portable container adapted for the transportation of refrigerated or frozen goods, e.g., groceries. In another aspect, this invention relates to a portable container equipped with an insert for holding carbon dioxide ($CO_2$) ice, typically in snow or pellet form. In yet another aspect, this invention relates to a portable container that can convert from a container adapted for transporting refrigerated goods to a container for transporting frozen goods simply by inverting a $CO_2$ ice-containing insert.

With the growth of the .com industry, the need to transport refrigerated or frozen goods from a central distribution center (e.g., warehouse, grocery store, etc.) to a consumer (e.g., individual, business, etc.) in an effective and efficient manner has also grown. Effective transport means that the goods are conveyed from one point to another without material diminution of their quality, and efficient transport means that the goods are conveyed quickly and inexpensively.

In the context of transporting refrigerated or frozen food stuffs, the portable container (or tote) ideally should exhibit a number of beneficial properties. The tote should be large enough to hold a reasonable amount of groceries, e.g., one or two fully packed, standard-size grocery bags, yet sufficiently light so that it does not add significantly to the total weight of the groceries. The tote should be reusable over extended periods of time, and thus resistant to the routine impact, water, solvent, temperature and similar abuse that is commonly encountered in transporting goods from once place to another. In addition, the tote should be easy to use, e.g., easily opened and closed, packed, carried, stored, cleaned, etc., and it should easily convert from a condition for transporting refrigerated goods to a condition for transporting frozen goods, and vice versa. In this regard, this desirable tote is markedly different than conventional totes which are designed for transporting only hot or cold foods, e.g., totes for delivering hot pizza or cold beverages.

Various containers are known that use an insert containing carbon dioxide ice or snow (the latter simply a shaved or aerated form of the former), but none of these embody all of the desired features described in the proceeding paragraph.

For example, U.S. Pat. No. 3,971,231 to Derry teaches a refrigerator comprising an insulated cabinet with an access opening and at least one dry ice ($CO_2$) carrier removably disposed within the cabinet. The insert comprises perforated and nonperforated walls opposed to one another that promoted refrigerated or freezing conditions, respectively, in the space adjacent the wall(s).

Kornish et al. teach in U.S. Pat. No. 3,678,703 a container for transporting or storing packaged frozen foods. The freezing element of this container is located in the cover of the container, and the freezing element comprises a heat-absorbing medium, preferably a mixture of water and propylene glycol.

Two other food storage and cooling devices of interest are U.S. Pat. No. 3,800,554 to Knapp, et al. and U.S. Pat. No. 1,654,828 to Nelson. Both use dry ice as the cooling agent, but neither are particularly well adapted for easy transport of refrigerated or frozen grocery items. The Nelson cabinet is designed more for storage then transport, and the Knapp, et al. cabinet is designed for use in travel trailers, camper units and the like.

SUMMARY OF INVENTION

In one embodiment of this invention, a tote for transporting refrigerated or frozen goods comprises a container with an access opening and a coolant insert. The container, typically in a trapezoidal or rectangular configuration, is sized to receive one or two fully packed, standard-size grocery sacks containing refrigerated or frozen foods. The container is typically of lightweight, e.g., constructed from a lightweight, insulated plastic and, optionally, is equipped with a corrugated plastic liner. The access opening to the container is, in one embodiment, one or more cover flaps that when open, give full access to the interior of the container.

The insert is typically in the shape of a thin, rectangular, shallow box in which carbon dioxide ice, typically in the form of pellets or snow, is placed. One of the top or bottom walls of the box is perforated while the other wall is solid and/or insulated. The box is designed to rest at or near the top of the sidewalls of the container such that it overlays the food stuffs within the container but does not interfere with the closure of the container. If the container contains frozen food stuffs, then the perforated wall of the insert is opposite the foodstuffs. If the container holds refrigerated food stuffs then the solid and/or insulated wall of the insert is opposite the foodstuffs.

In an alternative embodiment, the container has a detachable lid designed to receive and hold the insert.

In one specific embodiment of the invention, the tote comprises an insulated container and a coolant insert, the container comprising:

A. a durable, impact-resistant shell having a bottom wall and at least one side wall, all walls with interior and exterior surfaces, the interior surfaces defining a container volume and the internal surface of the side wall defining a container internal periphery;

B. an insulation liner adapted to fit adjacent the interior surface of the shell, the liner having a height that is less than the height of the shell so that the top edge of the liner forms a ledge about the internal periphery of the shell; and C. a cover adapted to seal the container volume from its environment; the coolant insert comprising:

a. a durable, impact-resistant shell comprising at least one side wall, a perforated floor, and an access cover;

b. an insulation liner for the cover; and c. a coolant;

the coolant insert adapted to fit within the container such that the coolant insert rests (i) upon the ledge formed by the top edge of the at least one side wall of the insulation liner, and (ii) within the shell such that the container cover can close to form a seal between the container volume and the environment. The container volume is, of course, the volume defined by the interior surfaces of the shell (with the cover closed), and the internal periphery is the length of a line drawn across the internal surfaces of the side walls and parallel to the plane of the bottom wall. If the tote is in the shape of a trapezoid or cone, then the internal periphery of the container will vary, of course, with height of the line measured from the bottom wall. If the container is in the shape of a cylinder or cone, then it has a single side wall. If it is in the shape of a polygon, then it has at least three side walls.

BRIEF DESCRIPTION OF DRAWINGS

FIG. 5 is a sectional view of the tote of FIG. 1 along line 5—5.

FIG. 6 is a perspective view of the tote of FIG. 1 with an alternative cover shown in an exploded view.

FIG. 7 is a sectional view of the tote of FIG. 6 along line 7—7.

DETAILED DESCRIPTION

Various embodiments of the invention are described by reference to the drawings in which like numerals are employed to designate like parts. Various items of equipment, such as fittings, mountings, sensors (e.g., temperature gauges), etc., have been omitted to simplify the description. However, such conventional equipment and its use are known to those of skill in the art, and such equipment can be employed as desired. Moreover, although the invention is described below in the context of the transport of refrigerated or frozen food stuffs or groceries, those skilled in the art will recognize that the invention has applicability to the transport and/or storage of many different refrigerated or frozen products or items, e.g., medical supplies, biological material, chemicals and the like.

Figure 1:
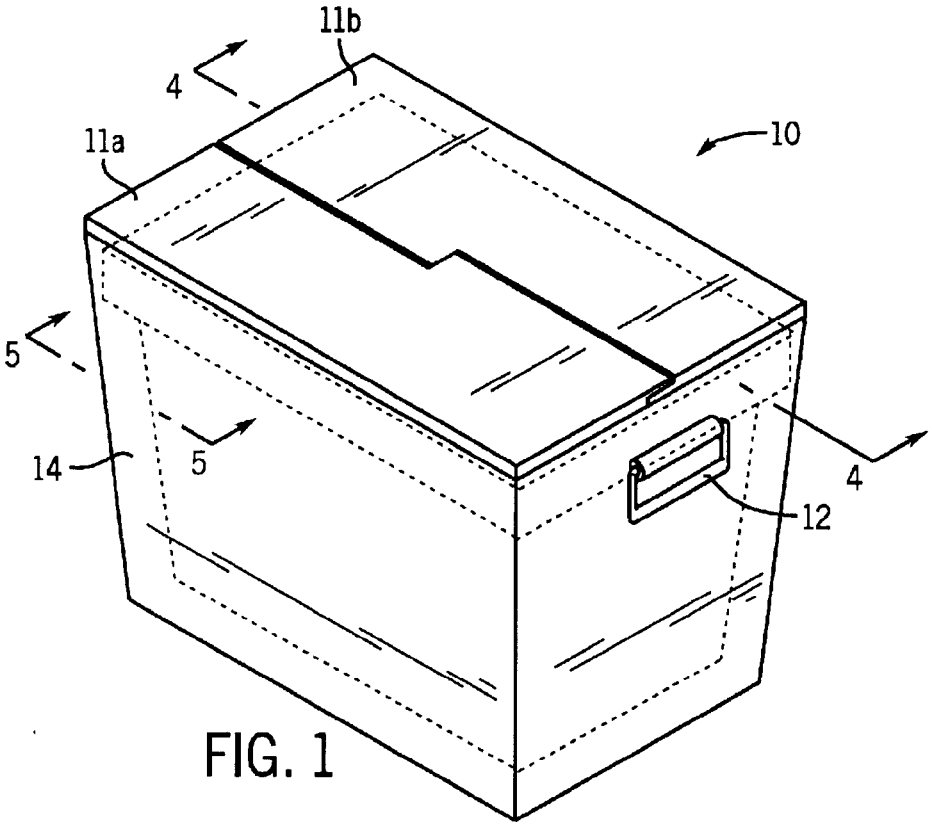
FIG. 1 is a perspective view of one embodiment of a tote in a closed configuration.
Figure 4:
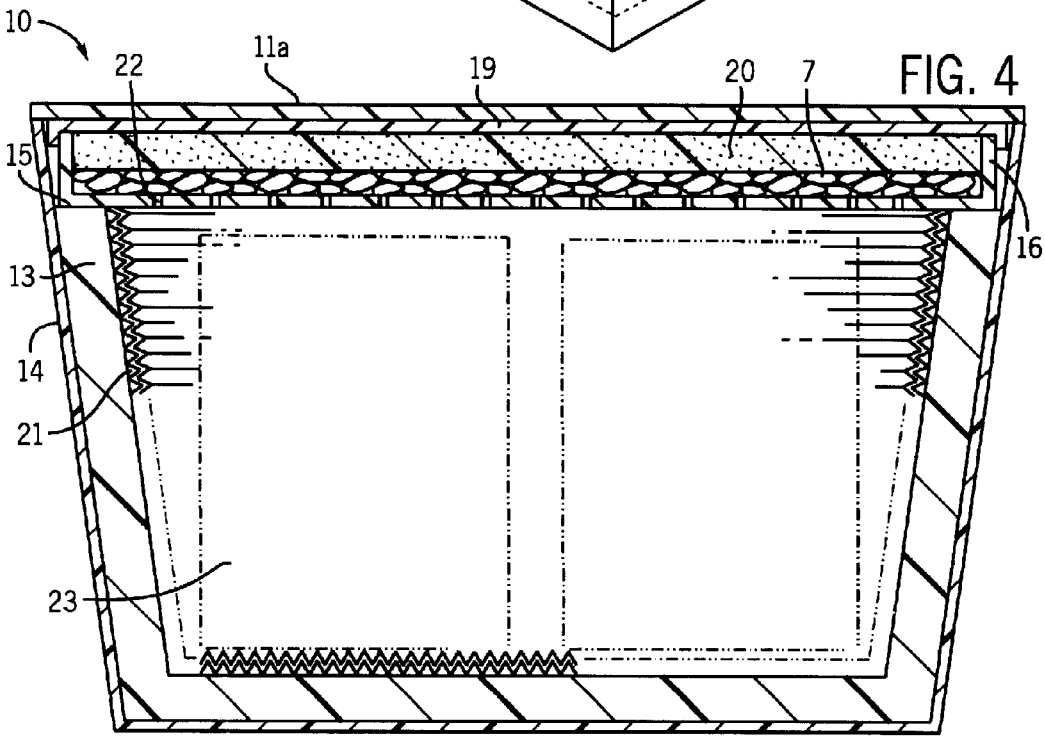
FIG. 4 is a cross-sectional view of the tote of FIG. 1 along line 4—4.

FIG. 1 describes one embodiment of the portable container or tote of this invention. Tote 10 is shown with a trapezoidal configuration, but it can be of any convenient shape. Typically the tote is shaped and sized to accommodate the transport of articles for which it was designed. For example, totes for the delivery of refrigerated or frozen food stuffs from a distribution center, e.g., a grocery store or warehouse, are sized to carry one or two fully packed, standard-size grocery bags, and to be carried with relative ease by an individual of moderate strength. These totes typically have a flat bottom to provide stability while it is positioned on a floor, table top, shelf, van or truck floor, etc. during packing, unpacking, transport or storage. The trapezoidal configuration promotes even circulation of cold air about refrigerated or frozen goods that are contained within both the tote and a conventional grocery sack (as depicted in FIG. 4).

The tote is constructed to be both light and durable. Lightweight, e.g., about 3 or less pounds, is desirable to avoid additional burden to the individual that must transport the tote when it is either full or empty. Durability is important because during routine packing, transport and unpacking, the tote is likely to encounter numerous impacts from the various surfaces upon or against which it is placed and with other totes (in the context of its use as one of a number of totes in a commercial delivery operation). Likewise, preferably the interior surface of the tote is also constructed of a durable material to resist impact damage associated with routine packing and unpacking of the foodstuffs, and the jostling of the food stuffs within the tote during transport.

In addition to lightweight and durability, the tote must be insulated, i.e., it must provide a thermal barrier between its interior and the environment. Since the tote is designed to preserve the refrigerated or frozen condition of its contents during transport and/or storage, its construction includes an appropriate insulation material, e.g, a polystyrene foam insert.

Tote 10 of FIG. 1 is shown in a closed configuration, i.e., flaps 11*a* and 11*b* are folded over the top of the container to form a lid which seals the interior of the tote from the environment. Flaps 11*a* and 11*b* can join with one another in any conventional manner, e.g, a form fit, mechanical fastener, pressure sensitive adhesive, a Velcro™ fastening strip, and the like. Each flap is foldably joined to a side wall 14 so that when the container is in an opened configuration (FIG. 2), the flaps can fold or swing away from the top of the tote to provide full access to the interior of the tote. The flaps, as well as side walls 14 and the bottom wall (not shown), are preferably constructed of a thin, durable plastic, e.g., polypropylene, polyester, nylon, etc. For convenience, the tote is optionally equipped with one or more pairs of handles 12 or other carrying assist (e.g., shoulder strap, wheels and pull strap, etc. (not shown)).

Figure 2:
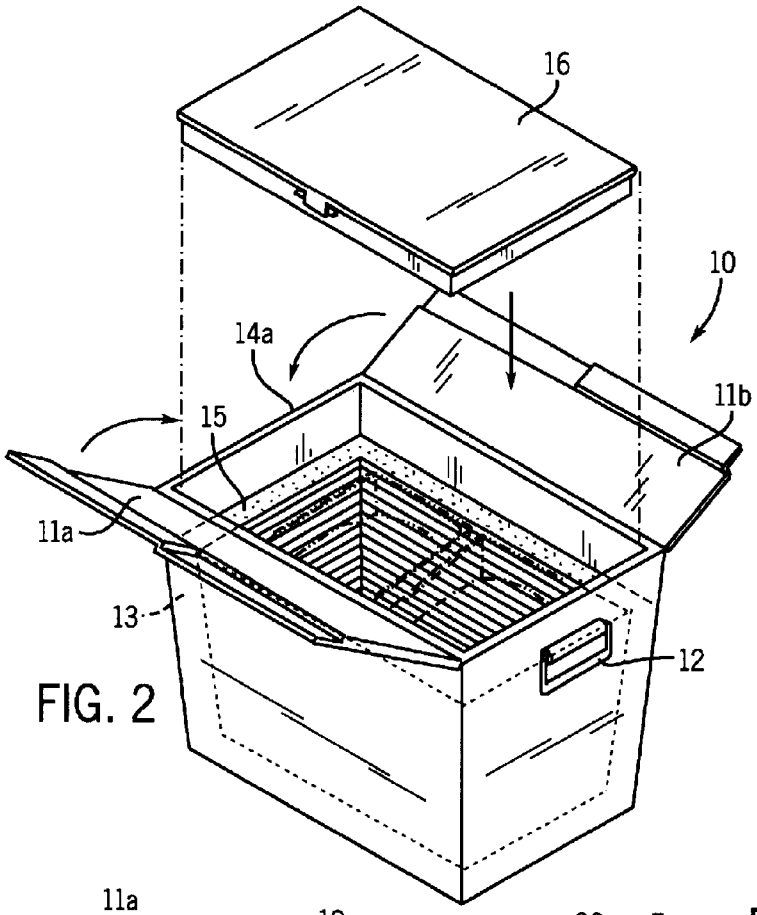
FIG. 2 is a perspective view of the tote of FIG. 1 in an opened configuration with an exploded view of one embodiment of a $CO_2$ snow insert.

As previously noted, FIG. 2 shows tote 10 in an opened configuration. FIG. 2 also shows tote 10 with molded foam insert 13 fitted within the side and bottom walls of tote 10 to provide an insulation layer for the tote. Molded foam insert 13 consists of four sidewalls and a floor, and they can be joined or abutted to their respective tote side and bottom walls in any conventional manner, e.g., adhesive, compression fit, etc. The thickness of molded foam insert 13 is dependent, in part, on the insulation properties of the foam itself, but typically about ½ inch of conventional polystyrene board is adequate for many commercial applications.

Foam insert 13 is designed such that when inside the tote, the top edge of its side walls forms ledge 15. Ledge 15 is below top edge 14*a* of side walls 14, and it provides a surface upon which dry-ice containing insert 16 (described below) can rest. Ledge 15 is sufficiently below top edge 14*a* of side walls 14 such that flaps 11*a* and 11*b* can close over $CO_2$-insert 16 to provide an effective seal or barrier between the interior of tote 10 and the environment.

Figure 3:
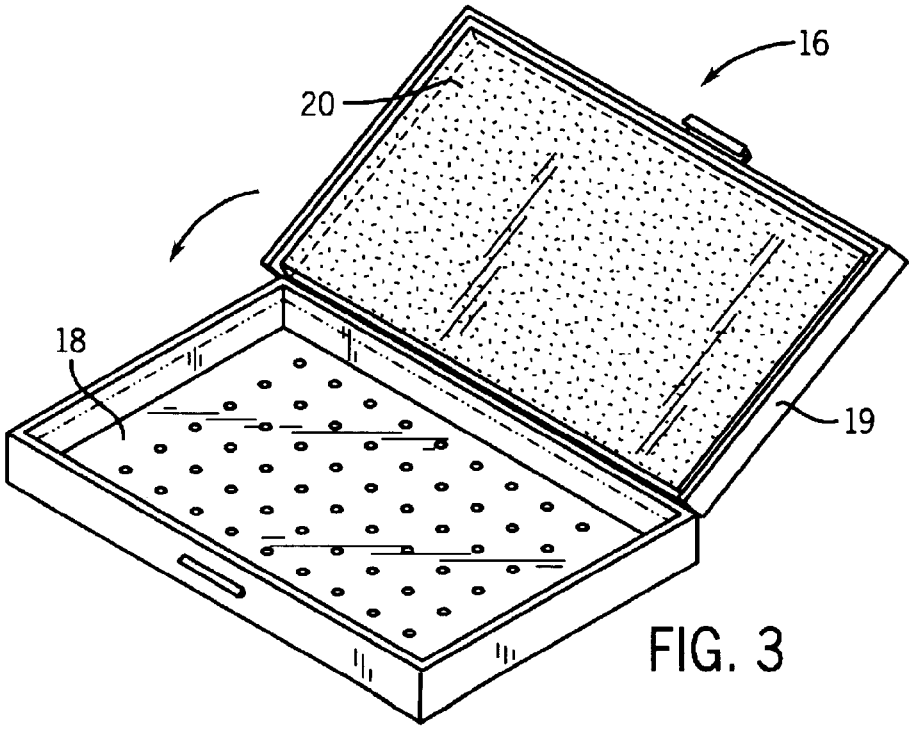
FIG. 3 is a perspective view of the $CO_2$ snow containing insert of FIG. 2.

FIG. 3 describes one embodiment of a $CO_2$-insert. In this embodiment, insert 16 is designed to fit snuggly within tote 10 by resting on ledge 15. The insert comprises four sidewalls joined to one another and perforated floor 18 and cover 19. Insert 16 is designed to hold dry ice 17 (shown in FIG. 4), preferably in snow or pellet form, and the sidewalls, floor and cover of the insert are typically constructed of durable plastic, e.g., polypropylene. The cover of insert 16 comprises insulation liner 20 (typically polystyrene foam board).

FIG. 4 describes tote 16 in a closed configuration with insert 16 resting on ledge 15, and containing two standard-size grocery sacks 23 (both shown in phantom outline). Tote 10 comprises side walls 14 lined with insulated molded foam insert 13 and, optionally, a corrugated liner 21. Optional liner 21 performs at least two functions. First, it guards against impact damage to foam insert 13. Second, the corrugation of liner 21 increases its surface area and thus the insulation qualities of the tote itself. FIG. 5 shows the relationship of side wall 14 to foam insert 13 to corrugated liner 21.

Carbon dioxide insert 16 rests on ledge 15 such that the volume in which grocery bags 23 are held are totally enclosed within tote 10 and cover flaps 11*a* and 11*b* (not shown) enclose on one another to seal tote 10 against the environment. If the contents of the grocery bags are frozen food stuffs, then insert 16 is positioned such that perforated floor 18 is opposite the interior of tote 10 (as shown in FIG. 4). Perforations 22 allow gaseous $CO_2$ that sublimates from $CO_2$ pellets 17 to circulate about and to maintain these foods stuffs in a frozen state. If the contents of grocery bags 23 are refrigerated, then insert 16 is reversed such that foam liner 20 is opposite (not shown) interior of tote 10. For a properly constructed tote, these configurations will maintain the interior temperature of the tote at 0° F. and a 40° F., respectively, for about eight hours when the tote is in a 90° F. environment.

FIGS. 6 and 7 describe an alternative cover or lid design for tote 10. Flaps 11*a* and 11*b* of tote 10 of FIG. 1 are replaced with lid 24 which comprises recess 25 into which $CO_2$-insert 16 is inserted (e.g., with a compression fit). Lid 24 is designed to rest on the top edge of the tote exterior walls 14 while insert 16 rests on ledge 15. In yet another embodiment (now shown), insert 16 is designed to replace both flaps 11*a* and 11*b* and lid 24, i.e., it is designed to serve as both a cover for the tote and as a carbon dioxide container.

Although the invention has been described in considerable detail through the proceeding embodiments, this detail is for the purpose of illustration. Many variations and modifications can be made without departing from the spirit and scope of the invention as described in the pending claims.

What is claimed is:

1. A tote for transporting refrigerated or frozen goods, the tote comprising an insulated container and a coolant insert, the container comprising:

A. a durable, impact-resistant shell having a bottom wall and at least one side wall, the bottom and side walls with interior and exterior surfaces, the interior surfaces defining a container volume and the internal surface of the side wall defining a container internal periphery;

B. an insulation liner adapted to fit adjacent the interior surface of the shell, the liner having a height that is less than the height of the shell so that the top edge of the liner forms a ledge about the internal periphery of the shell; and C. a cover adapted to seal the container volume from its environment; the coolant insert comprising:

a. a durable, impact-resistant shell comprising at least one side wall, a perforated floor, and an access cover;

b. an insulation liner for the access cover; and c. a coolant;

the coolant insert adapted to fit within the container such that the coolant insert rests (i) upon the ledge formed by the top edge of the at least one side wall of the insulation liner, and (ii) within the shell such that the container cover can close to form a seal between the container volume and the environment.

2.The tote of claim 1, further comprising a durable, corrugated liner that fits inside the insulation liner.

3. The tote of claim 1 in which the coolant is carbon dioxide ice.

4. The tote of claim 3 in which the carbon dioxide ice is in the form of snow or pellets.

5.The tote of claim 1 in which the shell comprises a durable plastic.

6. The tote of claim 5 in which the insulation liner is polystyrene foam board.

7. The tote of claim 6 in which the cover comprises a durable plastic.

8. The tote of claim 7 in which the insulation liner of the cover comprises polystyrene foam board.

9. The tote of claim 1 in which the cover is a pair of flaps flodably attached to at least one side wall.

10. The tote of claim 1 in which the cover is a removable lid with top and bottom surfaces, the bottom surface equipped with a recess sized to receive and hold the coolant insert floor or access cover.

* * * * *

UNITED STATES PATENT AND TRADEMARK OFFICE

CERTIFICATE OF CORRECTION

PATENT NO. : 6,295,830 B1
DATED : October 2, 2001
INVENTOR(S) : Michael D. Newman It is certified that error appears in the above-identified patent and that said Letters Patent is hereby corrected as shown below:

Claim 9,
Line 29, delete "flodably" and insert therefor -- foldably --.

Signed and Sealed this

Nineteenth Day of March, 2002

*Attest:*

*Attesting Officer*

JAMES E. ROGAN
*Director of the United States Patent and Trademark Office*